US009868184B2

(12) United States Patent
Moss et al.

(10) Patent No.: US 9,868,184 B2
(45) Date of Patent: Jan. 16, 2018

(54) SEMI-AUTOMATED VESSEL SANDING

(71) Applicants: William Harris Moss, Coral Springs, FL (US); Michael Souliotis, Ft Lauderdale, FL (US)

(72) Inventors: William Harris Moss, Coral Springs, FL (US); Michael Souliotis, Ft Lauderdale, FL (US)

( * ) Notice: Subject to any disclaimer, the term of this patent is extended or adjusted under 35 U.S.C. 154(b) by 34 days.

(21) Appl. No.: 14/981,991

(22) Filed: Dec. 29, 2015

(65) Prior Publication Data

US 2017/0182625 A1 Jun. 29, 2017

(51) Int. Cl.

| | |
|---|---|
| ***B24B 49/10*** | (2006.01) |
| ***B24B 23/00*** | (2006.01) |
| ***B24B 23/04*** | (2006.01) |
| ***B24B 55/10*** | (2006.01) |

(52) U.S. Cl.
CPC ..... *B24B 23/005* (2013.01); *B24B 23/04* (2013.01); *B24B 55/105* (2013.01)

(58) Field of Classification Search
CPC ..... B24B 23/02; B24B 49/10
USPC ..... 451/359, 357, 354, 456, 5
See application file for complete search history.

(56) References Cited

U.S. PATENT DOCUMENTS

| | | | | |
|---|---|---|---|---|
| 1,349,167 | A * | 8/1920 | Pattosien | B63B 59/06 114/222 |
| 1,641,130 | A * | 8/1927 | Elliott | B23B 39/00 451/294 |
| 3,835,498 | A * | 9/1974 | Arato | B60S 3/06 134/123 |
| 4,102,084 | A | 7/1978 | Blomquist | |
| 5,077,941 | A * | 1/1992 | Whitney | B24B 19/26 451/11 |
| 6,352,227 | B1 | 3/2002 | Hathaway | |
| 6,991,529 | B2 | 1/2006 | Annis et al. | |
| 7,022,044 | B2 | 4/2006 | Bohler | |
| 8,517,799 | B2 | 8/2013 | Panergo et al. | |
| 2010/0178849 | A1* | 7/2010 | Gobbi | B24B 7/182 451/41 |
| 2015/0290761 | A1* | 10/2015 | Richardson | B24B 7/182 451/41 |

* cited by examiner

*Primary Examiner* — Robert Rose
(74) *Attorney, Agent, or Firm* — Christopher & Weisberg, P.A.

(57) ABSTRACT

A method and apparatus for semi-automating the surface preparation of a vessel via abrading to remove old paint and polish the surface of newly painted vessel surfaces, eliminating the manual exertion to push heavy random orbital sanders up against the sides and bottoms of a vessel.

6 Claims, 4 Drawing Sheets

SEMI-AUTOMATED VESSEL SANDING

FIELD OF THE INVENTION

The present invention relates to maintenance of vessels (yachts, boats, large motor homes, buses, planes, and building walls and floors); specifically, periodic surface preparation via abrading to remove old paint (sanding) and waxing, polishing and/or buffing to finish the surface of newly painted vessel surfaces in aftermarket docks, maintenance and repair yards, or in harbors.

BACKGROUND OF THE INVENTION

All marine vessels have a bottom paint or coating designed to discourage weeds, barnacles, and other aquatic organisms from attaching themselves to (and in the case of wooden boats, eating) the underwater portion of a vessel's hull. If the vessel stays in the water year round or during most or all of the boating season, application of bottom paint is pretty much the rule. Periodic bottom-paint application, cleaning, and renewal become a permanent part of the vessel's routine maintenance schedule.

There are numerous examples of sanding devices for abrading curved surfaces such as the sides and bottom of vessels in the prior art—U.S. Pat. No. 4,102,084 (Blomquist) and U.S. Pat. No. 7,022,044 (Böhler). However, these devices must be handheld. A great amount of manual strain and human exertion is required for sanding and surface preparation while manually pushing heavy random orbital sanders up against the sides and bottoms of the vessel. In addition, the operator is required to crouch, bend, and twist to maintain adequate force on the abrading device to sand or polish the surface, or build platforms and use extenders to access higher elevation work areas.

U.S. Pat. No. 6,991,529 (Annis et al.) describes a hand manipulated tool for sanding, but this apparatus still requires considerable manual exertion to make contact force with a curved surface.

U.S. Pat. No. 8,517,799 (Panergo et al.) uses a double ball joint connecting a random orbital sander to a robot for sanding and polishing airplanes in a factory floor environment. This is a similar application to vessel surface preparation, but the robot is designed for multiple replications of the same surface (assembly stalls for airplanes) where the factory floor environment and the object surface to be sanded and polished is predictable. It is noted that U.S. Pat. No. 6,352,227 (Hathaway) describes a similar segmented, ball joint support for tools, lamps, cameras and faucets.

The problem with all prior art is that automated, robotic sanders are designed for factory floor environments on multiple products where the pathway for the robot can be determined and replicated many times. The problem with maintenance of an aquatic vessel is that the size and shape of surface to be sanded and polished is unknown, the job is one-of-a-kind to the contractor performing the maintenance; and the workplace environment is variable. Owners of large vessels may be unwilling to bring their vessel to the apparatus (that is, a robotic sanding station), but insist that the maintenance be performed on their dock or on the water where the vessel is located.

Therefore, the object of this invention is to provide a semi-automated vessel surface sanding and polishing apparatus that can eliminate human exertion; reduce labor; and reduce the duration to perform surface sanding and polishing of the sides and bottoms of vessels subject to periodic bottom-paint application, cleaning, and renewal.

SUMMARY OF THE INVENTION

The present invention relates to a semi-automated vessel surface sanding and polishing apparatus. The apparatus consists of:

a) a random orbital sander; said random orbital sander having a changeable tool head to change the surface of the sander head from among sanding, scrubbing (washing), buffing, or polishing style tool heads;

b) a holder with a spring that forces the random orbital sander to remain tangent to the curved vessel surface at the point of contact between the random orbital sander and the vessel surface, with the contact (normal) force perpendicular to the surface of the vessel at the point of contact between the random orbital sander and the vessel surface;

c) a long transverse shaft connected to the random orbital sander and holder with a pivot point and counterweight to provide to provide a torque to push the random orbital sander against the vessel surface;

d) a telescoping platform with locking casters to move the apparatus to any position in the x-y plane and adjust the elevation of the pivot, point of the long transverse counterweight e) a plurality of rotating swivel joints to enable an operator to move the random orbital sander over a radial area of 30-50 $ft^2$ (3-5 $m^2$) centered on the initial contact point between the random orbital sander and the vessel surface by pushing or pulling the long transverse shaft forward-or-backward, side-to-side, or up-and-down;

f) a camera attached to the random orbital sander holder and a video display attached to the long transverse shaft at the opposite end from the random orbital sander holder to enable viewing, by the operator.

DESCRIPTION OF THE PREFERRED EMBODIMENTS

Figure 1:
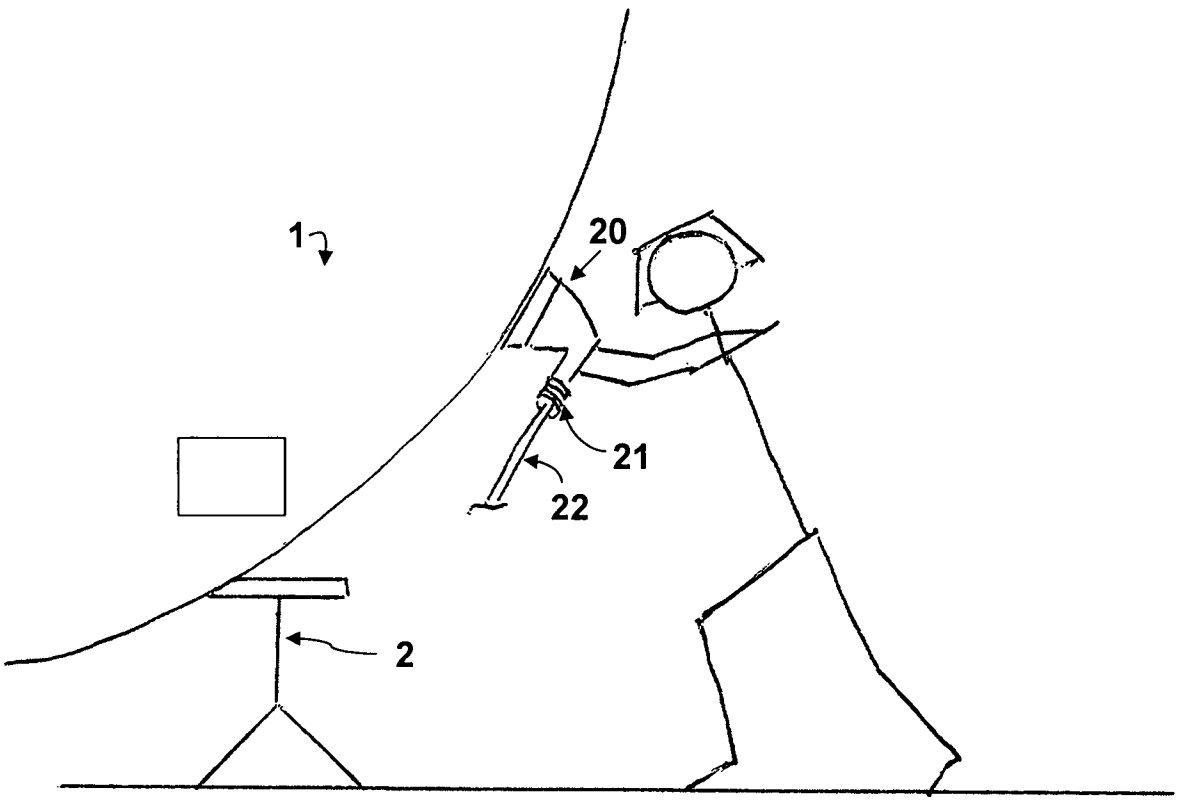
FIG. 1 is a depiction of prior art (manual sanding).

The subject of the invention is a method and apparatus (10) for reducing manual exertion, labor and duration for maintenance of a vessel (1) during periodic surface preparation via abrading to remove old paint and polishing to finish the surface of newly painted vessel surfaces. The method for surface preparation is different from prior art. Referring to FIG. 1, a laborer applies a random orbital sander (20) with manual force to the surface of a vessel (1) which is placed on boat stands (2) to raise the vessel to provide access. The random orbital sander has a coupling (21) to connect the random orbital sander to pneumatic or electric power and vacuum to withdraw dust particles (22). A great amount of manual strain and human exertion is required for sanding and surface preparation while manually pushing heavy random orbital sanders up against the sides and bottoms of the vessel.

Figure 2:
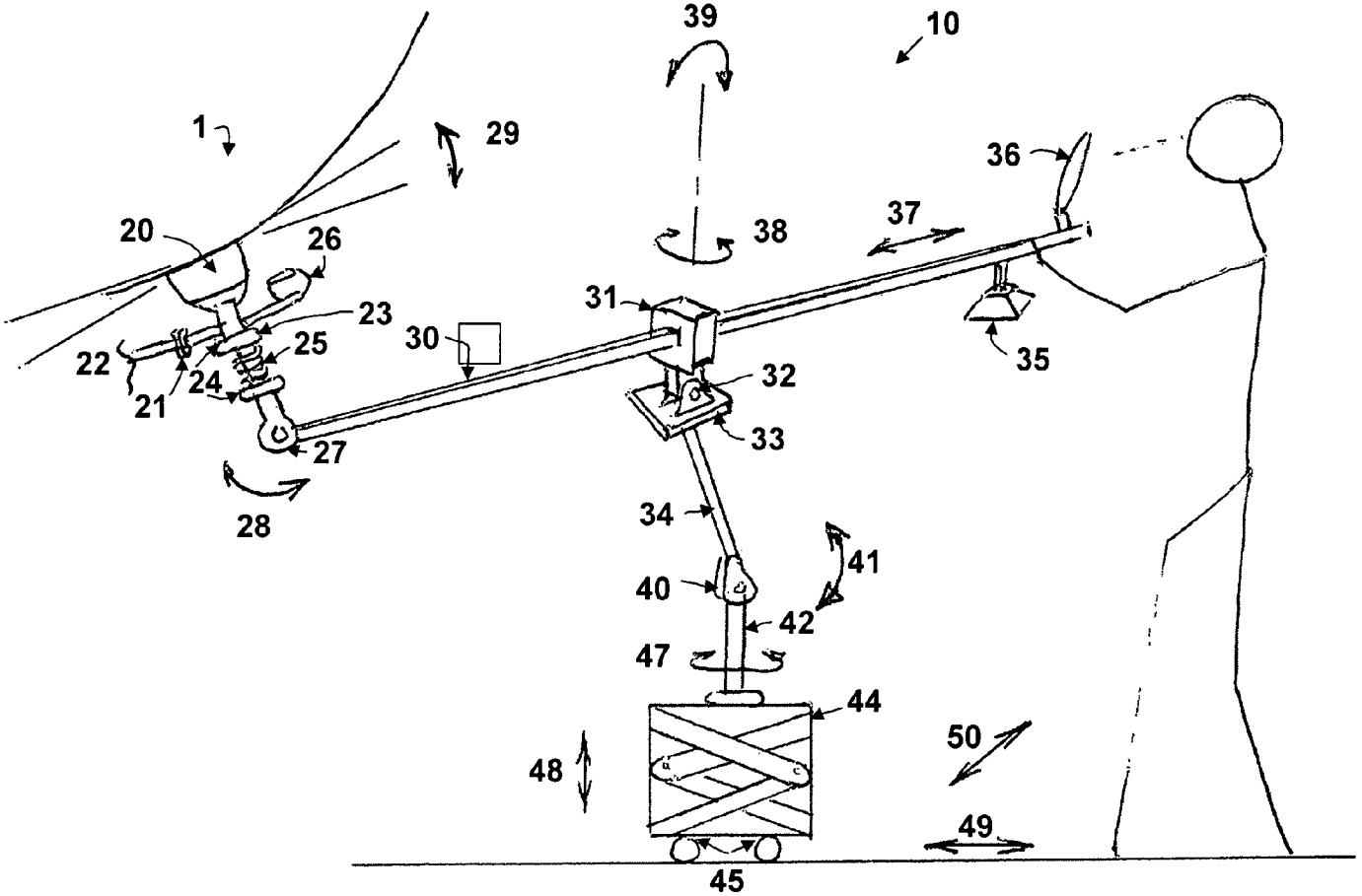
FIG. 2 is a cross-sectional schematic view of the invention.

The method and apparatus for semi-automating the surface preparation of a vessel which is the subject of this invention is depicted in FIG. 2. The semi-automated vessel sanding apparatus (10) that is used for abrading and polishing the curved surface of a vessel (1) consists of a random orbital sander (20) and holder (22); a long transverse shaft (30) with a pivoting shaft holder (31) and counterweight (35); a vertical shaft (34); a movable telescoping platform (44) mounted on locking casters (45); and a video camera (25) and video display (36) for remote viewing when the line of sight between the operator and the vessel surface being sanded or polished is obstructed.

The random orbital sander (20) has a coupling (21) that connects the random orbital sander to pneumatic or electric power (22). The random orbital sander is attached to the apparatus (10) with a holder (22) that is connected to a spring-loaded shaft (24) that includes a spring (25) that restricts the movement of the plane of the random orbital sander that is in contact with the vessel surface to +/−15 degrees from the tangent angle of the random orbital sander plane (29) and the vessel surface at the point of contact.

The long transverse shaft (30) has a pivoting shaft holder (31) connected to a rotating swivel mount (32) that is attached to a rotating platform (33) at the top end of the vertical shaft (34). The bottom end of the vertical shaft is connected to a pivot joint (40) with a locking mechanism (41) that is attached to the upper end of a second vertical shaft (42) which has a rotating swivel (43) on its lower end.

The apparatus (10) is attached to a telescoping platform (44) that is mounted on four locking casters (45).

Figure 3:
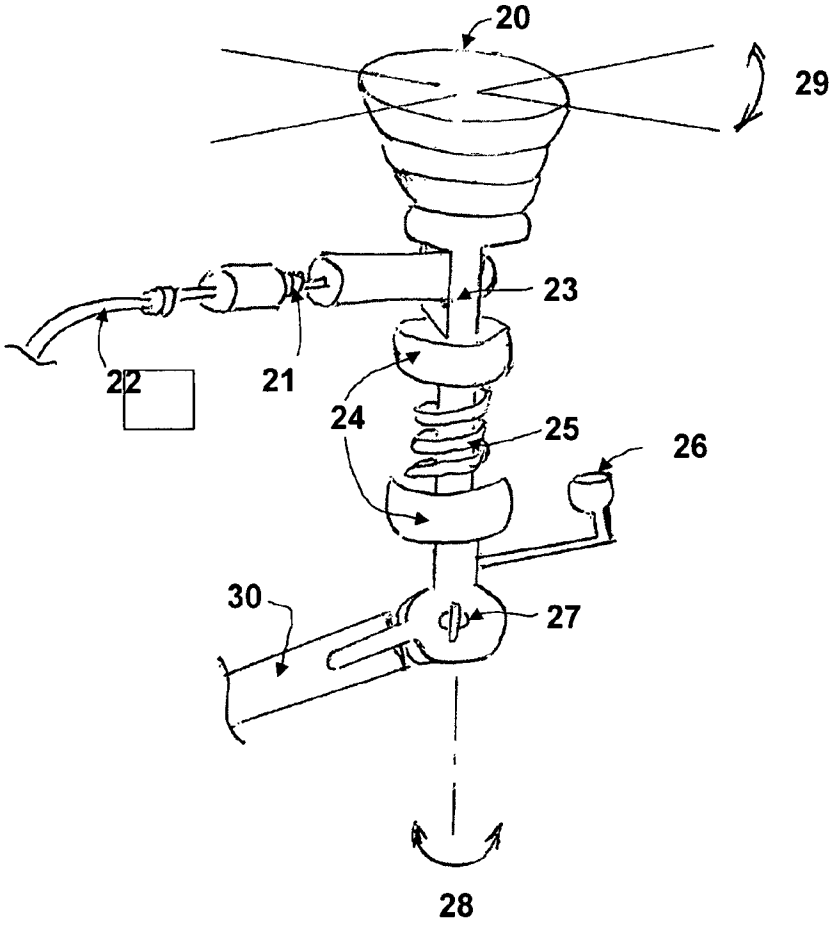
FIG. 3 is a detail of the random orbital sander holder.

The apparatus has a plurality of swivel joints, pivoting joints, and locking joints to enable the operator to move the point of contact between the random orbital sander and the surface of the vessel to any position in the x-y-z plane with translational movement (that is side-to-side in the x-direction; forward-backward in the y-direction; and up-down in the z-direction) and rotational movement (that is, clockwise/counterclockwise rotation of the x-, y- and z-axis in y-z, x-z, and x-y planes) of various swivel and pivot joints, consisting of:

a) a locking swivel pivot joint (27) to connect the random orbital sander holder (23) and the transverse shaft of the apparatus (30); said locking swivel pivot joint (27) enabling the random orbital sander handle to be positioned at a near-normal angle of 75-105 degrees to the vessel surface that is being abraded or polished (allow y-axis of pivot point to rotate in x-z plane (28)); with the spring-loaded shaft (24) maintaining the random orbital sander's abrading surface tangent to the vessel surface;

b) a pivoting transverse shaft holder swivel joint (31) that allows the long transverse shaft (30) of the apparatus to slides forward or backward through the swivel joint (allow x-axis translational motion in the y-z plant (37)) and rotate the transverse shaft (allow y-axis of the transverse shaft to rotate in x-z plane on the pivoting transverse shaft holder pivot point (38))

c) a rotating swivel joint (32) on the vertical shaft (34) connected to the pivoting transverse shaft holder swivel joint (33) (allow 360-degree z-axis rotation in the x-y plane (39));

d) a locking swivel joint (40) connecting the vertical shaft (34) to the lower vertical shaft (42) (allow y-axis rotation of the vertical shaft in the x-z plane (47));

e) a rotating swivel joint connecting the lower vertical shaft (42) and the telescoping platform (44) (alloy, 360-degree z-axis rotation in the x-y plane (48));

f) a telescoping platform (44) (allow vertical [z-axis] translational motion of the x-y plane (49));

g) locking casters (45) on the telescoping platform (44) (allow left-right [x-axis] and forward-back [y-axis] translational motion of the x-y plane (49) and (50));

Referring to FIG. 3, the random orbital sander (20) is attached to the apparatus with a holder (23) that is attached to a spring-loaded shaft (24), the purpose of which is to generate a restoring force to maintain the random orbital sander tangent to the vessel surface. The spring-loaded shaft restricts the tangent plane of the random orbital sander to the vessel to a variation of +/−15 degrees of the tangent surface over an area of surface to be sanded or polished of 30-50 $ft^2$ (3-5-$m^2$) (29). A locking pivot joint connects the spring loaded shaft and random orbital sander assembly to the long transverse shaft (30). The locking pivot joint (27) allows the operator to fix the y-angle of rotation between the random orbital sander and the long transverse shaft (28).

Figure 4:
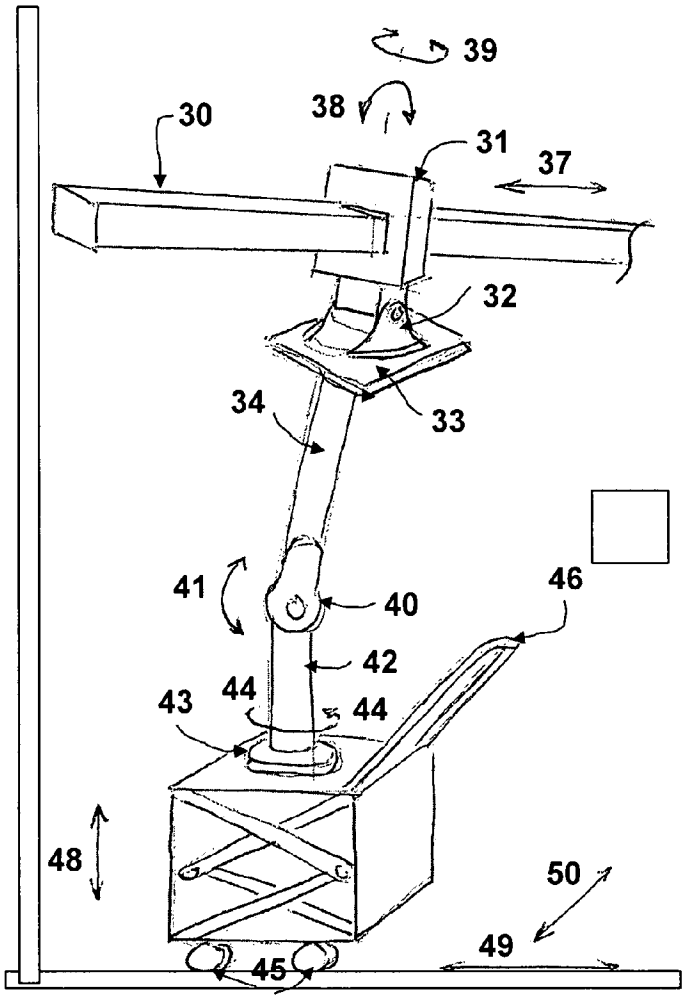
FIG. 4 is a detail of the telescoping platform and the rotating swivel joint that holds the transverse shaft.

Referring to FIG. 4, the long transverse shaft (30) has a pivoting transverse shaft holder swivel joint (31) for the shaft to slide the long transverse shaft (30) of the apparatus forward or backward (37), changing the pivot point on the shaft and the magnitude of the counterweight torque that keeps the random orbital sander tangent to the curved surface of the vessel. The pivoting transverse shaft holder is connected to a swivel joint (32) so that the transverse shaft can be rotated on its y-axis (38). The swivel joint (32) is attached to a second swivel joint (33) so that the long transverse shaft (30) and holder (31) can also be rotated about its z-axis (39).

The upper vertical shaft (34) and the lower vertical shaft (42) are connected with a locking pivot joint (40) to allow the operator to fix the y-angle of rotation between the upper vertical shaft (34) and the lower vertical shaft (42) (41). A rotating swivel joint (43) connects the lower vertical shaft (42) to the telescoping platform (44), allowing the z-axis of the entire transverse arm assembly (30, 31, 32, 33, 34, 40, and 42) to be rotated (47).

The telescoping platform (44) is mounted on four locking casters (45). A handle (46) is provided to push or pull the apparatus forward or backward (49) or side-to-side (50).

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

The invention claimed is:

1. An apparatus for semi-automating the process of sanding and surface preparation of a vessel to a) remove old paint from the sides and bottom of a vessel and b) polish new paint on the sides and bottom of a vessel; said apparatus comprising:

(a) a random orbital sander with changeable tool head to change the surface of the sander head from among sanding, scrubbing, buffing, or polishing style tool heads;

(b) a spring loaded holder for the random orbital sander that maintains said sander in the tangent position against the curved surface of the vessel as said sander is passed over a radial area of 30-50 $ft^2$ (3-5 $m^2$) centered on the initial contact point between the random orbital sander and the vessel surface;

(c) a connector to the orbital random sander to provide pneumatic or electric power and vacuum to withdraw dust particles generated in the sanding process;

(d) a video camera to provide remote viewing by the operator who will not have a direct line-of-sight of the sanding surface while operating the apparatus; said camera connected to an operator display panel;

(e) connecting extensions of the apparatus, including a transverse shaft, a vertical shaft; and a telescoping platform; said connecting extensions enabling the random orbital sander to be positioned tangent to the vessel surface i) over an area of surface to be sanded or polished of 30-50 $ft^2$ (3-5-$m^2$);

ii) with little manual strain and human exertion by the operator; said operator moving the position of contact between the random orbital sander and the vessel surface by simply moving the transverse shaft forward-and-backward; side-to-side; or up-and-down with simple arm motion and without any need to crouch, bend, push forward, sideways or down with high exertion, or pull backward, sideways or up with high exertion to effectively sand or polish said vessel surface (f) a series of swivel joints, pivoting joints, and locking joints to enable the operator to move the point of contact between the random orbital sander and the surface of the vessel to any position in the x-y-z plane with translational movement (that is side-to-side in the x-direction; forward backward in the y-direction; and up-down in the z direction) and rotational movement (that is, clockwise/counterclockwise rotation of the x-, y- and z-axis in y-z, x-z, and x-y planes) of various swivel and pivot joints i) a spring-loaded holder maintaining the random orbital sander's abrading surface tangent to the vessel surface ii) a locking swivel pivot joint to connect the random orbital sander handle and the transverse shaft of the apparatus; said locking swivel pivot join enabling the random orbital sander holder to be positioned at a near-tangent angle of 75-105 degrees to the vessel surface that is being abraded or polished (allow y-axis of pivot point to rotate in x-z plane); with the spring loaded holder maintaining the random orbital sander's abrading surface tangent to the vessel surface;

iii) a pivoting transverse shaft holder swivel joint to slide the transverse shaft of the apparatus forward or backward through the swivel joint and rotate the transverse shaft (allow x-axis of the transverse shaft to rotate in y-z plane on the pivoting transverse shaft holder pivot point);

iv) a rotating swivel joint on the vertical shaft connected to the the pivoting transverse shaft holder swivel joint (allow 360-degree z-axis rotation in the x-y plane of the transverse shaft holder swivel joint);

v) a locking swivel joint connecting the vertical shaft to the lower swivel joint mounted on the telescoping platform to change vertical axis angle of the vertical shaft (allow z-axis rotation in the x-z plane);

v) a lower vertical swivel joint mounted on the telescoping platform to 360-degree rotation of the vertical shaft (allow 360-degree z-axis rotation);

vi) a telescoping platform (allow vertical [z-axis] translational motion of the x-y plane);

vii) locking casters on the telescoping platform (allow left-right and forward-back [x-axis and y-axis] translational motion of the x-y plane);

2. The apparatus as recited in claim 1, wherein the adjustable support device and platform comprises:

(a) Counter-weights and supports to reduce i) the manual strain and human exertion of performing sanding and surface preparation while manually pushing random orbital sanders up against the sides and bottoms of curved vessel surfaces in repair yards, on the docks, or in harbors;

ii) total labor hours for completion; and iii) total elapsed time for completion;

(b) Visual and aural feedback by way of remote video to enable human assistance of the device without direct line-of-sight contact between the human operator and the random orbital sander that is in contact with the sides and bottom of the vessel whose surface is being re-painted;

We claim:

1. An apparatus for semi-automating the process of sanding and surface preparation of a vessel comprising:

an adjustable support platform consisting of connecting extensions of the apparatus, including a transverse shaft, a vertical shaft, and a telescoping platform; and the connecting extensions enabling the random orbital sander to be positioned tangent to the vessel surface over an area of surface to be sanded or polished of 30-50 $ft^2$ (3-5-$m^2$) with little manual strain and human exertion by the operator, the operator moving the position of contact between the random orbital sander and the vessel surface by moving the transverse shaft at least one of the group consisting of forward-and-backward, side-to-side, and up-and-down with simple arm motion and without any need to crouch, bend, push forward, sideways or down with high exertion, or pull backward, sideways or up with high exertion to effectively sand or polish the vessel surface;

the apparatus being further configured to:

remove old paint from the sides and bottom of a vessel; and polish new paint on the sides and bottom of a vessel.

2. The apparatus as recited in claim 1, the apparatus comprising a random orbital sander with changeable tool head to change the surface of the sander head from among sanding, scrubbing, buffing, or polishing style tool heads and connectors to provide pneumatic or electric power and vacuum to withdraw dust particles generated in the sanding process.

3. The apparatus as recited in claim 1, the apparatus comprising a spring loaded holder for the random orbital sander that maintains the sander in the tangent position against the curved surface of the vessel as the sander is passed over a radial area of 30-50 $ft^2$ (3-5 $m^2$) centered on the initial contact point between the random orbital sander and the vessel surface.

4. An apparatus for semi-automating the process of sanding and surface preparation of a vessel the apparatus comprising a series of swivel joints, pivoting joints, and locking joints to enable the operator to move the point of contact between a random orbital sander and a surface of the vessel to any position in the x-y-z plane with translational movement (that is side-to-side in the x-direction; forward-backward in the y-direction; and up-down in the z-direction) and rotational movement (that is, clockwise/counterclockwise rotation of the x-, y- and z-axis in y-z, x-z, and x-y planes) of various swivel and pivot joints a) a spring-loaded holder maintaining the random orbital sander's abrading surface tangent to the vessel surface b) a locking swivel pivot joint to connect the random orbital sander handle and a transverse shaft of the apparatus; the locking swivel pivot join enabling the random orbital sander holder to be positioned at a near-tangent angle of 75-105 degrees to the vessel surface that is being abraded or polished (allow y-axis of pivot point to rotate in x-z plane); with the spring loaded holder maintaining the random orbital sander's abrading surface tangent to the vessel surface;

c) a pivoting transverse shaft holder swivel joint to slide the transverse shaft of the apparatus forward or backward through the swivel joint and rotate the transverse shaft (allow x-axis of the transverse shaft to rotate in y-z plane on the pivoting transverse shaft holder pivot point);

d) a rotating swivel joint on a vertical shaft connected to the the pivoting transverse shaft holder swivel joint (allow 360-degree z-axis rotation in the x-y plane of the transverse shaft holder swivel joint);

e) a locking swivel joint connecting the vertical shaft to the lower swivel joint mounted on the telescoping platform to change vertical axis angle of the vertical shaft (allow z-axis rotation in the x-z plane);

f) a lower vertical swivel joint mounted on the telescoping platform to enable 360-degree rotation of the vertical shaft (allow 360-degree z-axis rotation);

g) a telescoping platform to allow vertical [z-axis] translational motion of the x-y plane;

h) locking casters on the telescoping platform (allow left-right and forward-back [x-axis and y-axis] translational motion of the x-y plane).

5. The apparatus as recited in claim 1, the apparatus comprising visual and aural feedback by way of remote video to enable human assistance of the device without direct line-of-sight between the human operator and the random orbital sander that is in contact with the sides and bottom of the vessel, the visual and aural feedback consisting of a video camera attached to a spring loaded holder for the random orbital sander, and a remote video display panel attached to the transverse shaft of the apparatus to make possible viewing by the operator who will not have a direct line-of-sight of the sanding surface while operating the apparatus; the camera connected to the remote video display panel.

6. The apparatus as recited in claim 1, the apparatus comprising counter-weights attached to the transverse shaft to reduce the manual strain and human exertion of performing sanding and surface preparation while manually pushing random orbital sanders up against the sides and bottoms of curved vessel surfaces.

* * * * *